US012460438B2

(12) United States Patent
Stutz et al.

(10) Patent No.: US 12,460,438 B2
(45) Date of Patent: Nov. 4, 2025

(54) PARKING DEVICE MORE PARTICULARLY FOR BICYCLES

(71) Applicant: V-Locker AG, Dubendorf (CH)

(72) Inventors: Frido Stutz, Lufingen (CH); Daniel Turler, Boll (CH)

(73) Assignee: V-LOCKER AG, Dübendorf (CH)

( * ) Notice: Subject to any disclaimer, the term of this patent is extended or adjusted under 35 U.S.C. 154(b) by 87 days.

(21) Appl. No.: 18/041,877

(22) PCT Filed: Aug. 5, 2021

(86) PCT No.: PCT/EP2021/071931
§ 371 (c)(1),
(2) Date: Feb. 16, 2023

(87) PCT Pub. No.: WO2022/037965
PCT Pub. Date: Feb. 24, 2022

(65) Prior Publication Data

US 2023/0313552 A1 Oct. 5, 2023

(30) Foreign Application Priority Data

Aug. 17, 2020 (CH) ..... 1026/20

(51) Int. Cl.
*E04H 6/00* (2006.01)
*E04H 6/14* (2006.01)

(52) U.S. Cl.
CPC ..... *E04H 6/005* (2013.01); *E04H 6/14* (2013.01)

(58) Field of Classification Search
CPC ..... E04H 6/005; E04H 6/14
See application file for complete search history.

(56) References Cited

U.S. PATENT DOCUMENTS 3,547,281 A * 12/1970 Lichti ..... E04H 6/14 414/251
2004/0007441 A1* 1/2004 Levis-Thorne ..... E04H 6/14 198/475.1

(Continued)

FOREIGN PATENT DOCUMENTS

CN 205777757 U 12/2016
CN 107939101 A 4/2018

(Continued)

*Primary Examiner* — Saul Rodriguez
(74) *Attorney, Agent, or Firm* — HULTQUIST, PLLC; Steven J. Hultquist

(57) ABSTRACT

A parking device, more particularly for bicycles, is provided with a housing structure (3) having at least one entry opening (25) and a paternoster (1) arranged therein having a plurality of boxes (2) for receiving the bicycles preferably individually and with a controllable conveying means (13). By means of said conveying means (13), the boxes (2), which are open to the front, can be moved in a revolution in the housing structure (3). The housing structure (3) is formed in a modular manner as an independent structural unit depending on the desired number of boxes (2). The boxes (2) are dimensioned such that in each case preferably one bicycle can be moved through the entry opening (25) from the outside into the one (2) or moved out of same. This ensures that the parking of more particularly bicycles is easy to handle and at the same time the required construction space is optimally used with structurally simple means.

17 Claims, 3 Drawing Sheets

(56) References Cited

U.S. PATENT DOCUMENTS

| | | | |
|---|---|---|---|
| 2008/0150317 | A1 | 6/2008 | Kilcrease |
| 2012/0128453 | A1 | 5/2012 | Lee et al. |
| 2013/0001908 | A1 | 1/2013 | Kappinen |
| 2016/0033095 | A1 | 2/2016 | Kennedy |
| 2020/0115916 | A1 | 4/2020 | Mingyan |
| 2020/0141147 | A1 | 5/2020 | Mingyan et al. |

FOREIGN PATENT DOCUMENTS

| | | | |
|---|---|---|---|
| KR | 20110010282 | A | 2/2011 |
| WO | 2014017919 | A1 | 1/2014 |
| WO | 2022037965 | A1 | 2/2022 |

* cited by examiner

PARKING DEVICE MORE PARTICULARLY FOR BICYCLES

The invention relates to a parking device, in particular for bicycles, with a housing structure with at least one entry opening and a paternoster arranged therein with a plurality of boxes for receiving the bicycles, preferably individually, and with a controllable conveying means, by which the boxes, which are preferably open to the front, can be displaced in a revolution in the housing structure; this according to the preamble of claim 1.

In parking devices of this type mentioned at the outset, due to the constantly growing increase in the volume of traffic of environmental vehicles such as bicycles, there is an increased need for parking places. Using these, vehicles can be parked in ordered manner, and they are then largely protected against theft and damage. It has also transpired that the arrangement of parking spaces in a device which operates like a paternoster is advantageous for automating the parking process.

The object of the invention is to produce such a parking device for bicycles or similar vehicles which makes bicycle parking easier, and simultaneously ensures optimal use of the necessary construction space, with structurally simple means.

This object is achieved according to the invention by the features of claim 1.

According to the invention, this housing structure is formed in a modular manner as an independent structural unit depending on the desired number of boxes, wherein the boxes are dimensioned such that in each case preferably one bicycle can be moved through the entry opening from the outside into the one box or moved out of same.

The bicycles can thus be moved from outside into the boxes of the paternoster without entering same, and moved back out again, wherein the paternoster can be actuated by a conveying means for each bicycle, individually.

In this way it is possible that bicycles can be parked or removed quickly and without complications, and this takes place with a single conveying means for all boxes in the parking device.

The invention also provides that the paternoster is integrated in a housing structure with a plurality of modules, which structure is formed of a door module, one or more intermediate modules and a pulley module, wherein the modules are built one on top of the other in the manner of a tower, and the bicycles can be moved in to the boxes, open at the front side, through the door of the door module, transverse to the orbital plane of the paternoster.

This design makes it easy to adapt the structure to the respective capacity requirements and the housing structure can also be extended later on in any manner, without great outlay. Moreover, it offers free access to the boxes, also for example during installation or servicing of the device.

In this way it is advantageous if the door module is provided with a removable front side, in order, after removal of the front side, that the boxes can then be installed and removed from the front. In order to simplify this process, the invention provides that the boxes are suspended freely on their holders in the rear of the paternoster. Thereby, they can be installed and removed to the front without special tools.

It is likewise provided, for the purpose of uninterrupted operation, that the boxes are guided, vibration-free, through a form-locking channel in the form of a strap below the boxes at their loading point, arranged in the housing structure, or through an entry curve or additional chain which interacts with a coupling lever at the box.

In so doing, it is advantageous for operating and monitoring the parking device if the power unit for the conveying means and the controller are integrated and are placed, easily accessible, in an awning above the door of the door module.

The invention is explained in more detail below with reference to the drawing, with the help of embodiment examples. There are shown in:

Figure 1:
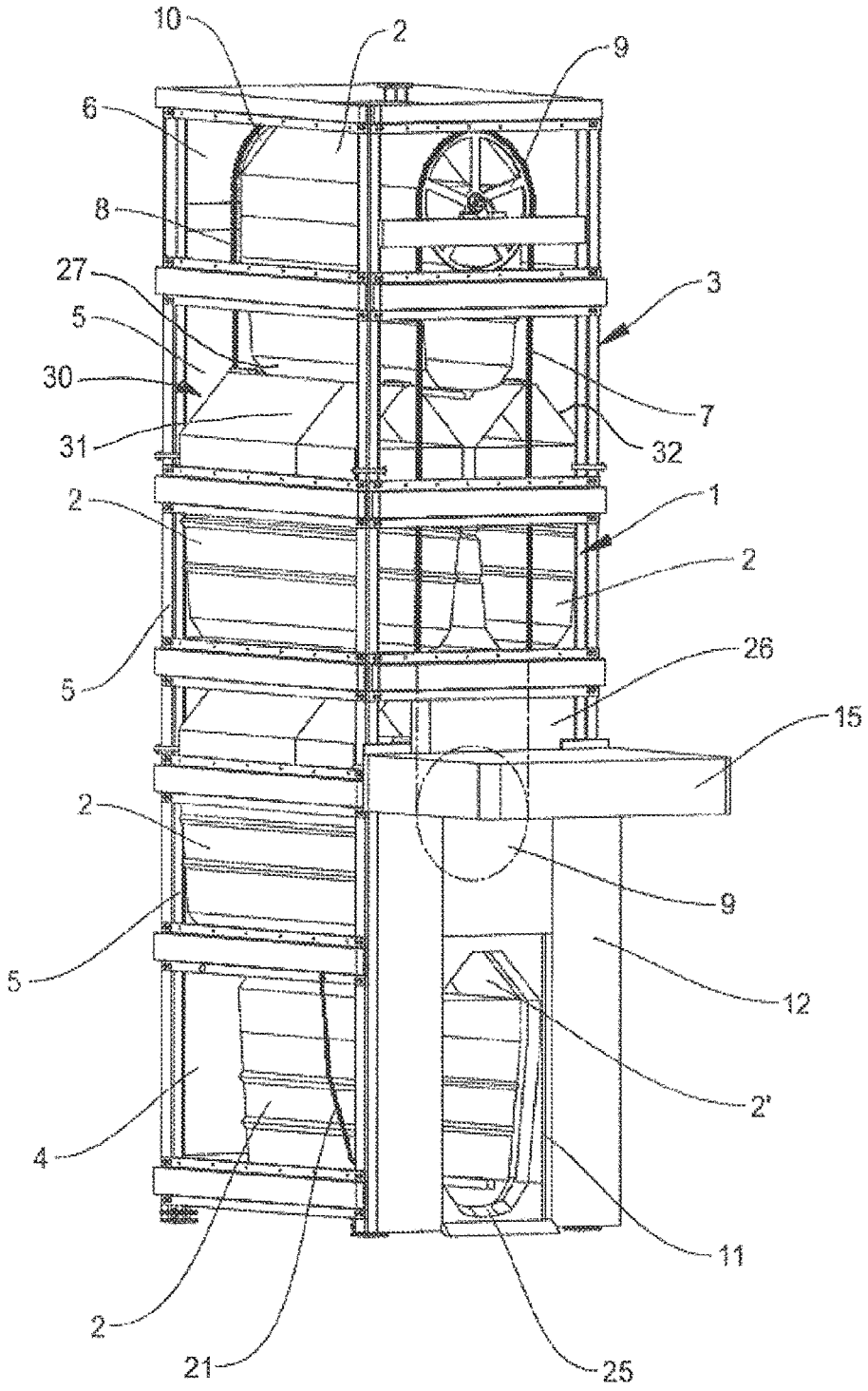
FIG. 1 is a parking device according to the invention for bicycles, shown in perspective view.

The parking device shown in FIG. 1 consists substantially of a paternoster 1 with a plurality of boxes 2 and a housing structure 3 surrounding the latter. The boxes 2 are dimensioned such that, in operation, they can each receive in particular one bicycle. However, it is not ruled out that these boxes could be calculated to be broader, and more than one bicycle could be received therein.

The paternoster 1 with the six boxes 2 is housed in the housing structure 3, for example assembled modularly from steel sections. This is composed of a door module 4, a plurality of intermediate modules 5 and a pulley module 6 which are built one on top of the other and can be placed either freestanding, or in or on available buildings. In so doing, such a tower or a plurality of them can be placed next to one another. The modular structure system allows for 6, 8, 10 or more parking spaces, depending on the structural height of the tower.

According to the invention, the housing structure 3 can be placed and fixed to any point with the necessary layout as an independent structural unit, without special foundations or any reinforcements needing to be built. With a corresponding construction, this housing structure 3 could also optionally be dismantled again without great outlay, and this parking device is thus also suitable for a temporary location.

The housing structure 3 is preferably provided with a wall, not shown in more detail, which wall can be made of any materials, for example fences and grids, which are air-permeable. It is also suitable for being fitted with advertising boards or marker boards.

The boxes 2 each have a cross-section which is designed to be approximately V-shaped on the underside, with a lower narrow side 2" and which preferably have a gabled roof structure 30 at the top 33, with roof areas 31, 32 pointing slopingly inwards, with the result that in particular a man's or woman's bicycle can be moved into same with little play to the side and the top. This V-shaped underside provides the advantage that, when moving a bicycle in or out from outside by its wheels, these are guided on this lower narrow side 2", as if on a rail. Moreover, each of these narrow sides 2" is allocated a ramp, brushes, wheel clamps or the like for locking or fixing a bicycle pushed therein.

The boxes 2 are produced from a dimensionally-stable material with an opening to the front, and their shape is chosen such that they can be transported next to one another in as narrow a spatial path as possible. Space can be saved with this cross-sectional shape of the respective boxes 2, running slopingly to the bottom and top, such that the distance between boxes can be kept as small as possible when changing direction of travel, and in so doing the topmost or lowermost box 2 in the paternoster 1 protrudes between the two boxes located below or above same, wherein these sloping roof surfaces 31, 32 each run approximately parallel to the abutting lateral surfaces 27 of the boxes.

As the boxes are dimensioned to be longer than they are wide, corresponding to the design of the bicycles, the described arrangement also offers a more compact design. A storage shelf 2' for personal items, such as clothes, helmet, gloves etc., is advantageously allocated to the upper part of the respective box 2. In so doing, the internal space of the box 2 is used optimally, below for the bicycle channel and above for this integrated storage shelf 2'.

The boxes 2 can be moved up and down preferably at the front and back by a conveying means, wherein this conveying means consists of drive wheels with a drive motor 13 and a conveying element on which the boxes are suspended with a specific minimum distance between one another. For this, chain drives, belt drives or the like, or even toothed belts or form-locking conveying elements which have the same effect, can be used. In the embodiment example, the boxes are suspended on a front carrier chain 7 and a rear carrier chain 8 as conveying elements, wherein both carrier chains are moved up and down by the chain wheels 9, 10 housed in the module sections.

At least one holder for pivotably receiving a box 2 is advantageously fixed to a respective conveying element of the conveying means such that the box effects a bracing of the respective conveying element in direction of travel due to its weight. Expediently, these conveying elements are, as mentioned, each designed as endless carrier chains 7, 8 running on at least two chain wheels 9, on which chains the respective holder is fixed to at least one of its chain members 8', extending outwards. A bearing element of the box, protruding about its pivot axis at the top of the box 2, is received in the holder outside of the chain member 8'. In so doing, this chain member 8' of the carrier chain 7, 8 is folded in each case opposite its direction of travel in the region between the chain wheels 9 by the resulting torque, due to the weight of the box, causing a slight shortening of the carrier chain 7, 8, and tensing corresponding to this.

An automatically actuatable door 11 is built into the door module 4, through which door an entry opening 25 is accessible or closed, and a bicycle can be moved into or out of the box 2 open to the front. The door 11 is arranged centrally, and the bicycles are moved through the entry opening 25 into the respective lowest lying box 2, transverse to the orbital plane of the paternoster 1. Moreover, the door module 4 is provided with a removable front side 12, wherein, after removal of same, the boxes 2 can then be installed or removed simply, from the front.

The parking device is optionally provided with an awning 15 above the door 11 and also with a cover 26 over the awning. A drive motor 13 and a controller 14 are contained in the removable cover 26, and the two of these are easily accessible with this positioning.

Figure 2:
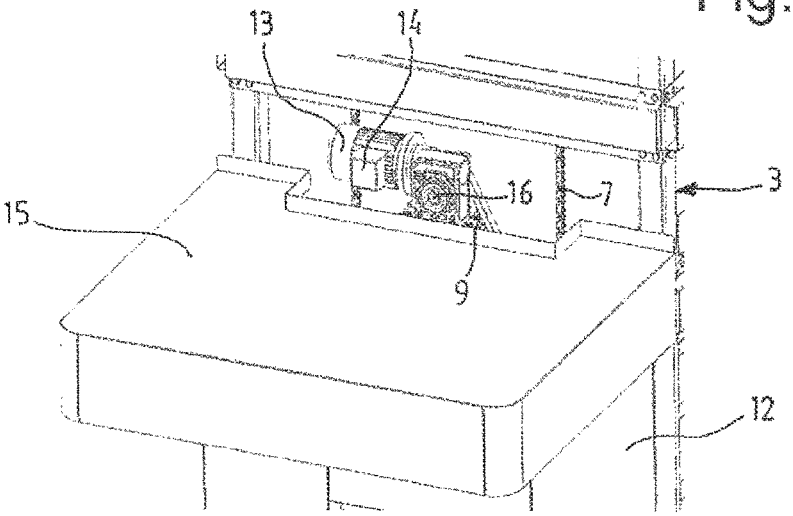
FIG. 2 is a partial perspective view of the conveying means and of the awning of the housing structure of the parking device according to FIG. 1.
Figure 3:
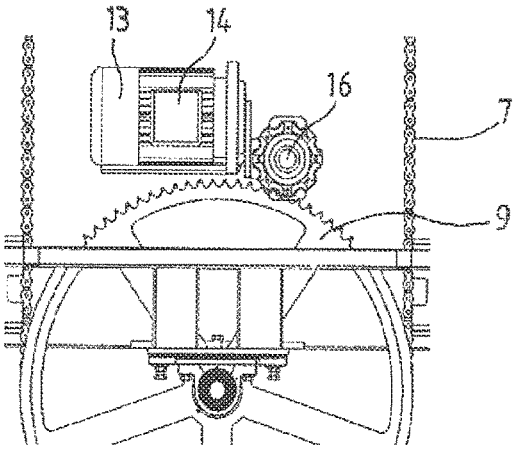
FIG. 3 is a view of the power unit of the conveying means according to FIG. 1.

As is apparent from FIG. 2 and FIG. 3, the bottom front chain wheel 9 is driven by the drive motor 13 with engagement of a pinwheel 16, wherein it is housed rotatable above the entry opening 25, as indicated in FIG. 1.

Figure 4:
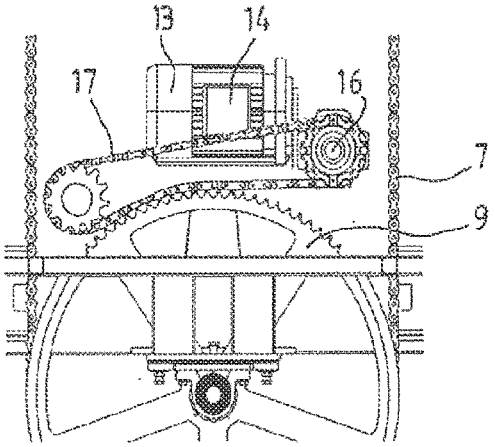
FIG. 4 is a view of an alternative power unit of the conveying means.

According to FIG. 4, this front chain wheel 9 can instead also be drivable with the engagement of a short looped chain 17 or even with a large sprocket wheel divided up into a plurality of smaller sprocket wheels. The drive motor 13 is designed such that it can drive the paternoster 1 in controlled manner in one or other orbital direction.

Figure 5:
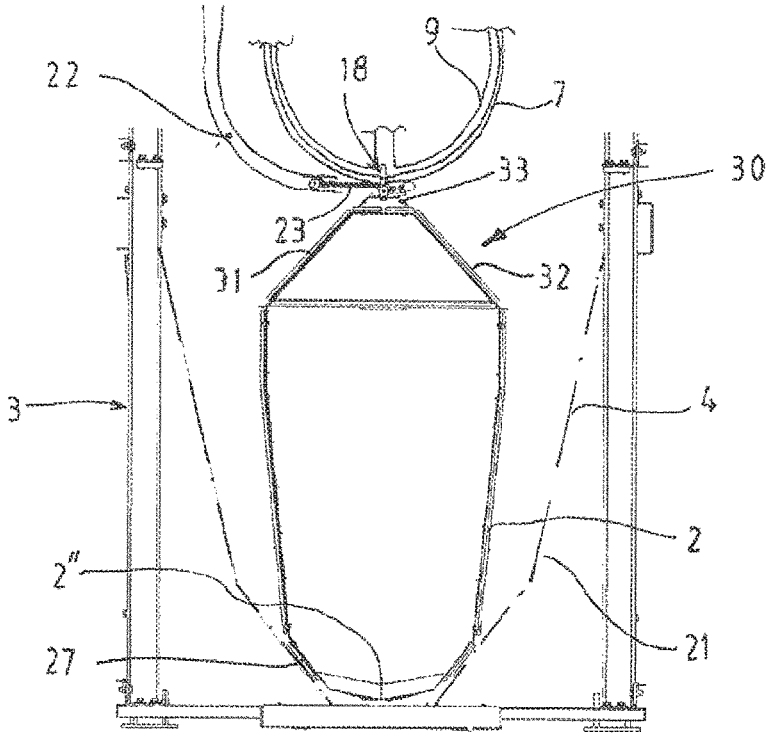
FIG. 5 is a cross-sectional view of a box within the indicated housing structure with a form-locking channel.

As is apparent from FIG. 5, in each case the lowest box 2 of the paternoster is moved centrally to the door module 4 during the parking procedure by the position of the lower chain wheels 9. In order to prevent the boxes 2 suspended on the top from being able to vibrate in this lowest position behind the door, they are guided with a form-locking channel into the housing structure 3, and thus held vibration-free. For this purpose, a fixed mounted entry curve 22 is provided interacting with a coupling lever 23 during suspension 18 of the respective box 2.

Instead of the curve 22, an additional chain can also be used to which the coupling lever 23 can be fixed instead of the curve. Alternatively, the channel of the boxes will be attached by a strap 21 fixed in the housing structure 3 on both sides of the underside, as shown in FIG. 1 and FIG. 5.

Figure 6:
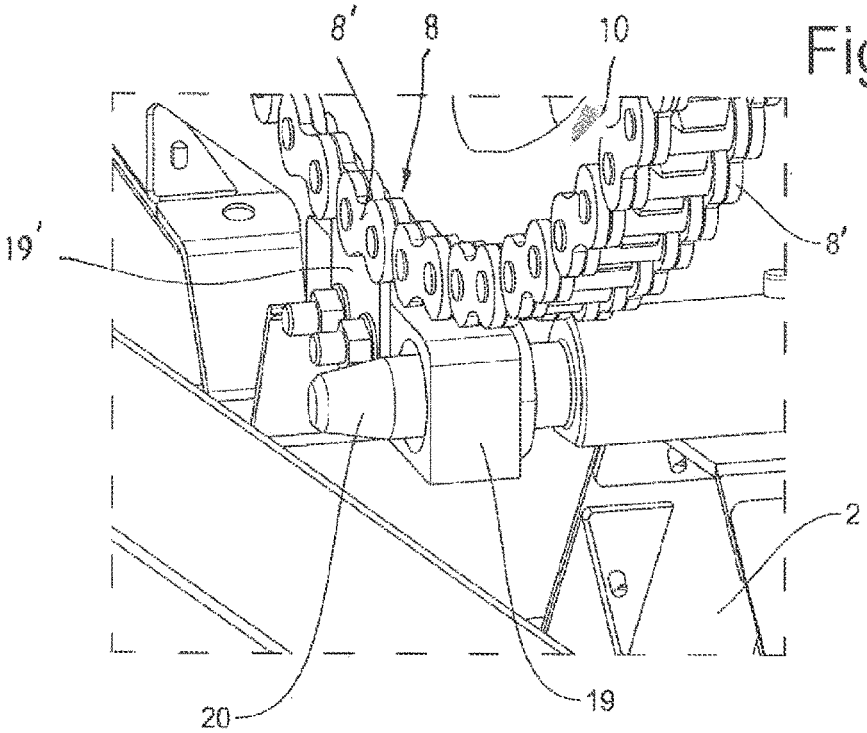
FIG. 6 is a partial perspective view with the box suspended in a holder on the conveying element.

FIG. 6 shows the suspension 18 of a box 2 from the rear, in its lowest position in the paternoster. In order to make possible installation and removable without tools, the boxes 2 are suspended on the back of the carrier chain 8 with a trunnion 20 in a holder 19 such that, during assembly, they can be pushed both in and out through the entry opening 25 at the front side and locked in this holder 19 with the trunnion 20, or can be removed during dismantling. The box 2 is held pivotable on the carrier chain 8 with this trunnion 20 housed rotatable in the holder 19. The holder 19 is made of a plate element 19' fixed to a chain member 8', with the opening for the bearing of the trunnion 20.

Due to this bearing element, designed as trunnion 20, of the box 2 in the holder 19 outside the chain member 8', the latter is folded in each case opposite its direction of travel in the region between the chain wheels 9 and the adjacent chain members by the resulting torque, due to the weight of the box 2, causing a slight shortening of the carrier chain 7, 8, and tensing corresponding to this.

Expediently, each of the boxes 2 contains an electric connection for battery charging, if so-called e-bikes are parked in there. The device also requires only sensor per unit which monitors the boxes for the presence of creatures.

The controller 14 can be connected to smartphones or the like, with a data or network connection, using a send and receive station. Authorized users can thus use the parking device via an app or the like, for reservation, payment, starting and ending parking, by radio. An operating panel is advantageously installed at the doors, by means of which these operations can likewise be carried out by the user.

At least one electric sensor is installed in each box to monitor the presence of creatures, in order to stop the paternoster if a creature is found in one of them.

The invention is sufficiently substantiated with the above embodiment examples. However, it may self-evidently also cover further variants. This housing structure could thus be made from concrete elements, wood plates, wooden frames, metal frames and/or other structural elements.

Self-evidently, the cross-section of a box could also have a different shape, for example approximately square, or the like.

To increase the capacity of parking spaces, it would also be possible to redesign the parking device according to FIG. 1 such that the conveying element is guided, preferably at the bottom in the door module and at the top in the pulley module, for example about two chain wheels arranged next to one another, or in some other similar way, with the result that not just one, but as in the intermediate module, even two boxes could be suspended arranged next to one another. In so doing, eight boxes, instead of six, could thus be used with the same structural height of the housing structure.

Additionally, instead of standing on the ground with the door module at the bottom, as represented in FIG. 1, the parking device could be arranged at least partly under the ground, and instead of being located at the bottom, the door module could be placed at the top, as pulley module or instead of an intermediate module. The conveying means with the wheels and the conveying elements would correspondingly have to be arranged somewhere else, in order that access is ensured from the front at the entry opening. This could for example be achieved by the boxes being supported analogously on the bottom of the conveying elements, or by not having a conveying element at the front with the entry opening, instead having it only at the back, wherein the boxes would then have to be supported on the conveying elements by corresponding holding means.

In principle, more than one door module could also be built in, for example at the top, above ground, and below, as shown in FIG. 1.

The invention claimed is:

1. A parking device, useful for bicycles, with a housing structure (3) with at least one entry opening (25) and a paternoster (1) arranged therein with a plurality of boxes (2) for receiving the bicycles, and with a controllable conveying means (13), by which the boxes (2) can be displaced in a revolution in the housing structure (3), wherein the housing structure (3) is formed as an independent structural unit depending on the desired number of boxes (2), wherein the boxes (2) are dimensioned such that bicycles can be moved through the entry opening (25) from the outside into the boxes (2) or moved out of same, and wherein the boxes each have a cross-section which is approximately V-shaped on the underside, with a lower narrow side and at the top, have a gabled roof structure with roof areas pointing slopingly inwards and wherein the inside of the boxes is provided, on the respective low narrow side, with ramps, brushes, or wheel clamps, for locking or fixing a bicycle pushed therein.

2. The parking device according to claim 1, characterized in that the housing structure (3) consists of a plurality of modules arranged on top of one another, which modules are formed of at least one door module (4), one or more intermediate modules (5) as well as at least one pulley module (6).

3. The parking device according to claim 1, wherein the housing structure is designed in the manner of a tower by the modules arranged on top of one another and the number of boxes is determined depending on their possible structural height.

4. The parking device according to claim 2, wherein a removable front side is allocated to the door module, wherein after removing the front side, the boxes are is inserted or removed at the entry opening.

5. The parking device according to claim 1, characterized in that the boxes (2) are each provided at the top with a storage shelf (2').

6. The parking device according to claim 1, wherein the conveying means is used to the front and rear side with the boxes, which means consists at least of a drive wheel with a drive motor and a conveying element on which the boxes are suspended in articulated manner at specific distances.

7. The parking device according to claim 6, wherein a chain wheel (9) is provided as conveying means at the top and bottom of the housing structure (3) and an endless carrier chain (7, 8) is provided as conveying element, and wherein as well as a pinwheel (16) or a short looped chain (17) or a rotary drive is are provided to drive the chain wheel directly.

8. The parking device according to claim 6, wherein the boxes are suspended on the conveying element to the rear each with at least one trunnion in a holder such that, during assembly, they are pushed both in and out through the entry opening at the front side and with the trunnion into the holder, without tool use.

9. The parking device according to claim 1, wherein on each conveying element of the conveying means, at least one holder for pivotably receiving a box is attached such that this box causes the respective conveying element to tense in its direction of travel, due to its weight.

10. The parking device according to claim 9, characterized in that the conveying elements each are designed as endless carrier chains (7, 8) running about at least two chain wheels (9), to which the respective holder is fixed on at least one of its chain members (8') extending outwards, wherein a bearing element protruding about its pivot axis at the top of the box (2) is received in the holder outside of the chain member (8').

11. The parking device according to claim 1, wherein the boxes are stabilized at least in the position in which a bicycle is pushed in or out of same through an additional form-locking channel in the housing structure.

12. The parking device according to claim 11, characterized in that the form-locking channel is formed by at least one strap (21) which comes into contact with same below the respective box (2), or is formed by an entry curve (22) or additional chain which interacts with a coupling lever (23) projecting respectively at the boxes.

13. The parking device according to claim 2, wherein a power unit and a controller for the conveying means are placed in an awning above the door of the door module.

14. The parking device according to claim 1, wherein the controller is equipped with a send and receive station, with a data/network connection via app to smartphones of authorized users, for use for at least one parking device operation selected from the group consisting of reservation, payment, entry and exit.

15. The parking device according to claim 1, wherein at least one electric sensor is provided for monitoring the presence of creatures in a respective box, in order to stop the paternoster when a creature is found in a box.

16. The parking device according to claim 1, wherein the housing structure is placed and fixed to any point with the necessary layout, without special foundations or any reinforcements needing to be built.

17. The parking device according to claim 1, wherein the boxes are open to the front.

* * * * *